United States Patent [19]

Schockman

[11] 4,364,505

[45] Dec. 21, 1982

[54] DOUBLE FEED ROLL LIFT MECHANISM

[75] Inventor: Robert L. Schockman, St. Henry, Ohio

[73] Assignee: The Minster Machine Company, Minster, Ohio

[21] Appl. No.: 230,020

[22] Filed: Jan. 30, 1981

[51] Int. Cl.[3] ..... B65H 17/22

[52] U.S. Cl. ..... 226/154; 226/35; 226/155; 226/177

[58] Field of Search ..... 226/33–35, 226/90, 155, 176, 177, 180, 188, 154; 83/57, 203, 209, 211; 72/251

[56] References Cited

U.S. PATENT DOCUMENTS

| | | | |
|---|---|---|---|
| 2,722,276 | 11/1955 | Revelle . | |
| 3,115,999 | 12/1963 | Wythe | 226/33 |
| 3,349,981 | 10/1967 | Hawkins et al. | 266/155 |
| 3,583,268 | 6/1971 | Scribner | 83/225 |
| 3,754,705 | 8/1973 | Wiig | 226/90 |
| 3,782,618 | 1/1974 | Voorhees | 226/155 |
| 3,837,552 | 9/1974 | Monahan | 226/122 |
| 3,937,112 | 2/1976 | Geeson | 83/57 |
| 4,048,831 | 9/1977 | Fabian et al. | 72/251 |

*Primary Examiner*—Leonard D. Christian
*Attorney, Agent, or Firm*—Albert L. Jeffers; John F. Hoffman

[57] ABSTRACT

The invention relates to a hydraulically actuated feed roll lift mechanism for feeds utilized to feed strip stock into a machine, such as a mechanical press. Regulated hydraulic pressure acting against a piston that is connected to one of the feed rolls through a yoke forces the feed roll against the stock to grip the stock and cause an increment thereof to be fed into the press when the rolls are rotated. A roll opening cam, which is connected to the press crankshaft, advances a small piston to displace oil against the other side of the piston while the stock is at rest to thereby separate the rolls during the time that the dies are in contact with the stock in the press. The time at which roll separation is initiated is controlled by adjusting the angular position of the cam on its shaft, as by releasing a frictional lock mechanism, rotating the cam to the desired position, and then again locking it in place. The invention is particularly related to a double feed roll system wherein opposing feed rolls are located at the infeed and outfeed sides of the press so that the stock is both pushed and pulled therethrough. Identical cam roll lift mechanisms are utilized for both of the pairs of feed rolls wherein the cams are mounted on the same shaft and can be adjusted independently of each other. This enables the infeed and outfeed rolls to be separated at different times during the cycle of the press.

17 Claims, 8 Drawing Figures fig. 3
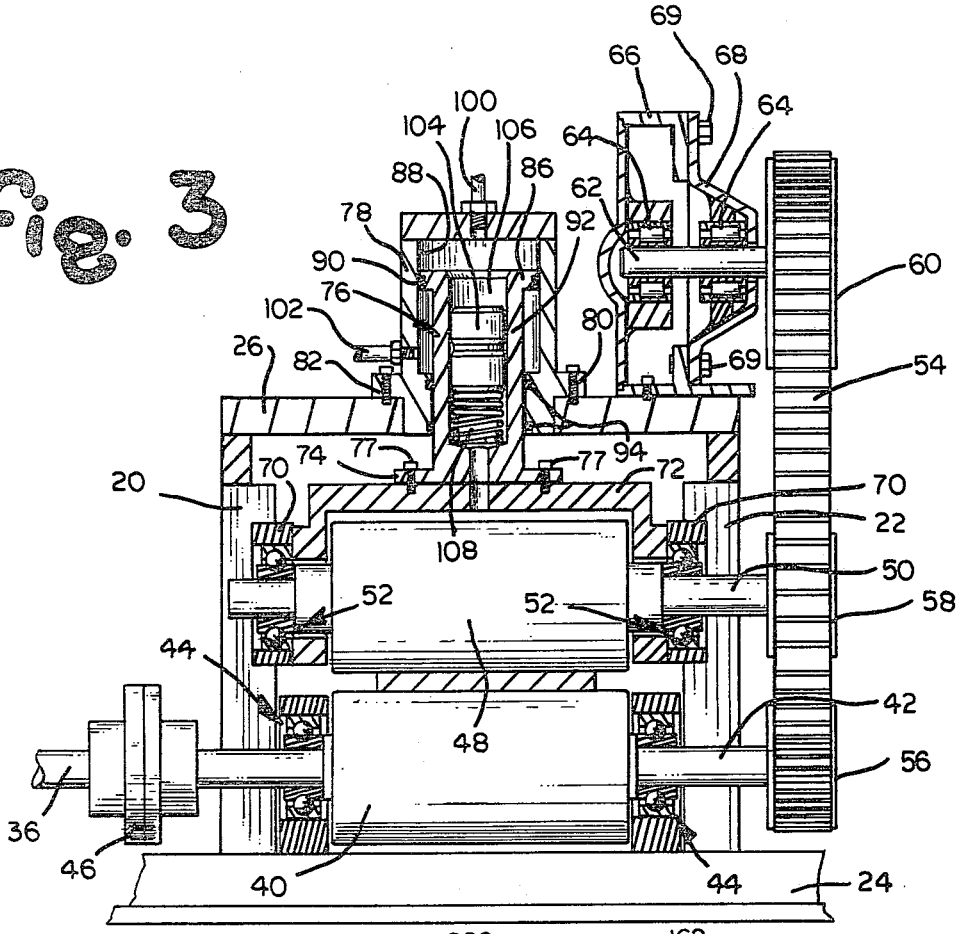
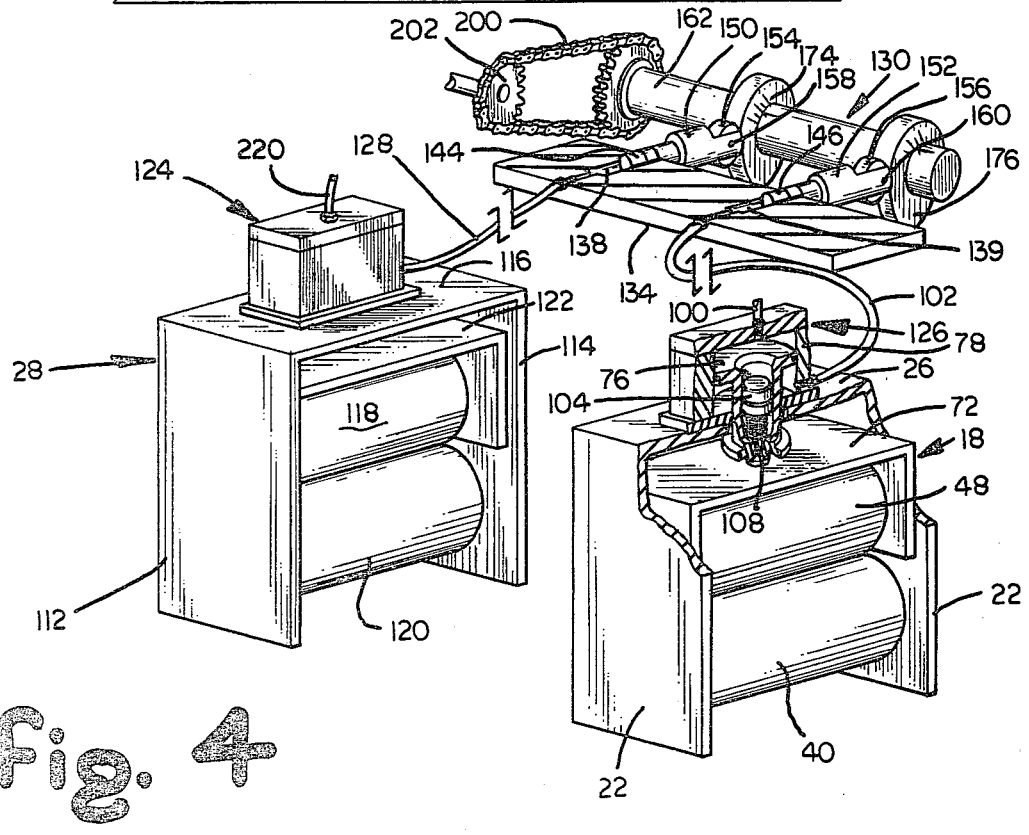
fig. 4 fig. 5
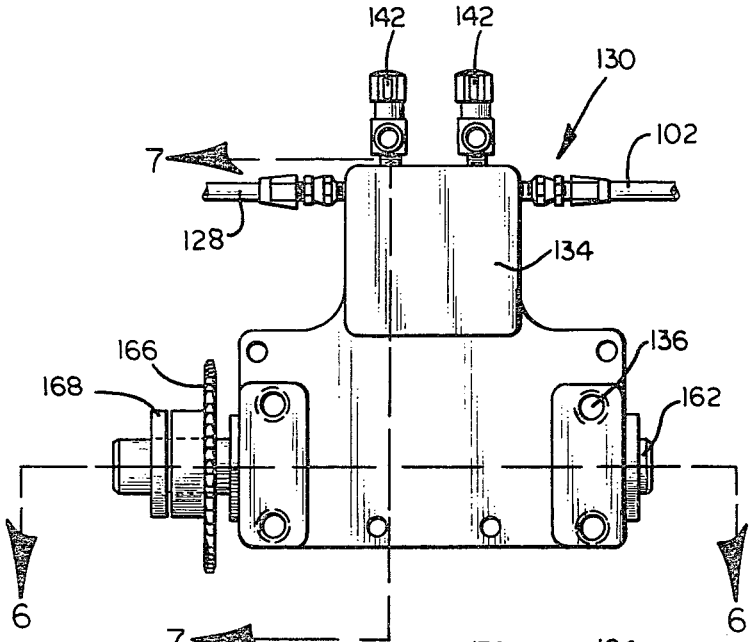
fig. 6
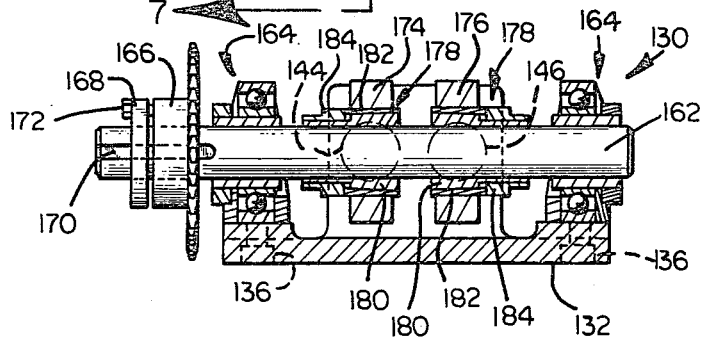
fig. 7
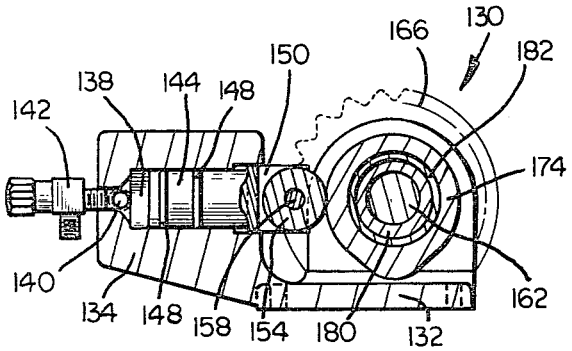
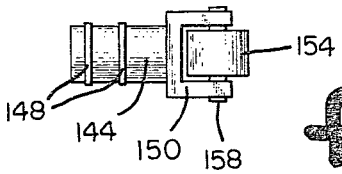
fig. 8

DOUBLE FEED ROLL LIFT MECHANISM

BACKGROUND OF THE INVENTION

The present invention relates to a strip stock feed apparatus for use in presses, and in particular to an adjustable double roll lift system for separating the roll pairs independently of each other.

Strip stock material, such as sheet steel and other materials, is generally fed off supply coils into the press through a pair of opposing rolls, which are driven in intermittent fashion by a power take-off from the press crankshaft. The rolls are urged toward each other so that they frictionally grip the stock as they rotate, which causes a length of the stock to be advanced into the press. In order to permit the stock to be properly aligned within the dies, as by pilots engaging pilot holes in a progressive die operation, it is necessary for the feed rolls to separate at a time just before the moving die comes into contact with the stock. A variety of mechanisms have been used in the past to accomplish this, such as cam lift mechanisms and mechanisms operated by hydraulic or pneumatic cylinders. One such lifting mechanism is disclosed in U.S. Pat. No. 3,782,618, which is owned by the assignee of the present application and is incorporated herein by reference. This mechanism incorporates a double acting piston that is rigidly connected to one of the feed rolls and urges the feed roll against the stock by means of hydraulic pressure developed on one side thereof. A cam is rotated in synchronism with the crankshaft of the press and actuates a plunger that displaces hydraulic fluid against the other side of the piston to separate the feed rolls at a particular time in the press cycle. No provisions are provided for adjusting the angular position of the cam on its shaft, however.

In running certain types of stock in the press, a single pair of rolls on the infeed side of the press is often not satisfactory. For example, in the case where very thick stock is being run, the infeed rolls may not be able to develop sufficient force or frictional gripping action to advance the stock quickly and accurately into the press. A more common situation is where very thin stock is being run, and the action of the infeed rolls in pushing the stock into the press causes it to buckle thereby producing a misfeed which can result in damage to the dies. Even in situations where the stock is sufficiently thick that it does not buckle when being pushed into the press by the infeed rolls, so much material may be removed therefrom by the dies that a very poor skeleton results. The skeleton may not have sufficient integrity to retain its shape as it is being pushed through the press so that it may buckle thereby causing a misfeed or interfering with the rewinding or chopping of the skeleton.

To avoid the problems discussed above when running very thick or thin stock or when the skeleton is poor, it is common practice to employ two pairs of rolls, one on the infeed side and the other on the outfeed side so that the stock is both pushed and pulled through the press. Since a certain amount of synchronization of the infeed and outfeed roll pairs is necessary, the roll lifters have typically been mechanically linked by a cross shaft, which is a large rotatable shaft that runs above or alongside the press between the infeed and outfeed units. As can be appreciated, such a mechanical structure is large and unwieldy and difficult to mount.

In some cases, it is desirable to separate the outfeed rolls at a different time than the infeed rolls. For example, in some cases it is desirable to close the infeed rolls slightly in advance of the outfeed rolls to avoid elongation of the stock.

SUMMARY OF THE INVENTION

The above-discussed problems and disadvantages of prior art double roll feed lifter mechanisms are overcome by the present invention, which synchronizes the infeed and outfeed roll lifts by a cam actuated hydraulic system. One of the rolls of the infeed pair and one of the rolls of the outfeed pair are moved toward and away from their opposing rolls by respective double-sided pistons. Hydraulic pressure acting against one side of each of the pistons urges these pistons in a direction which causes the stock to be gripped between them and their respective opposing rolls, so that as the rolls are rotated by the feed mechanism, a length of stock will be fed through the press. A pair of cams are mounted on a common shaft that is rotated in synchronism with the press as by a chain and sprocket or other linkage connecting it with the crankshaft of the press. As the cams rotate, they cause respective pistons to reciprocate in auxiliary cylinders that are connected to the cylinders on the other side of the aforementioned double acting cylinders by a pair of hydraulic lines. The hydraulic pressure developed by the cam actuated pistons pushes the cylinders in the opposite directions so that the infeed and outfeed rolls connected, respectively, to the double acting pistons are separated from their opposing rolls. A primary advantage of the system according to the present invention is that the infeed and outfeed rolls are synchronized by hydraulic pressure within hydraulic lines, rather than by a large cross shaft running between the two units.

The cams are adjustably mounted on the shaft, as by frictional locking wedges or any other appropriate device, so that the angular orientation of one cam with respect to the other can be changed. Since the rotation of the cams is directly responsible for the separation of the infeed and outfeed rolls, by changing the relative orientation of the cams, the respective times in the press cycle at which the infeed and outfeed rolls close and separate can be independently controlled. Thus, the outfeed rolls can be separated slightly ahead in time of the infeed rolls, or vice versa. Since the adjustment mechanism is adapted to be mounted externally of the press, adjustments in the relative angular orientations of the cams can be made without the necessity for gaining internal access to the feed. This enables adjustments to be made quickly and easily so that there is minimum machine downtime.

Specifically, the present invention relates to a roll lift system for use in a feed apparatus for feeding strip stock into a machine including first and second pairs of feed rolls adapted to be positioned at the infeed and outfeed sides of the machine. The lift system comprises first means for urging one of the rolls of the first pair in a direction either toward or away from the other roll of the first pair, a first expansible chamber device connected to the one roll for urging the roll in the opposite direction when the expansible chamber device is pressurized, second means for urging one of the rolls of the second pair either toward or away from the other roll of the second pair, and a second expansible chamber device connected to the roll of the second pair for urging that roll in the opposite direction when the expansible chamber device is pressurized. First and second positive displacement hydraulic actuators are connected to the first and second expansible chamber means, respectively, and each comprises a plunger which pressurizes the respective expansible chamber means. A shaft rotatable on an axis and having a pair of cam elements mounted thereon are positioned in close proximity to the plungers so that the plungers are actuated by the cams as the shaft rotates. The cams are adjustably mounted on the shaft independently of each other so that independent control of the feed roll closing and separation for the infeed and outfeed sides of the press can be achieved.

The present invention also relates to a roll lift mechanism for adjusting the time in the cycle of the press at which a single roll pair is separated. Specifically, the roll lift mechanism comprises means for urging one of the rolls of the pair in a direction either toward or away from the other roll, an expansible chamber device connected to the roll for urging the roll in the opposite direction when the expansible chamber device is pressurized, and a positive displacement hydraulic actuator connected to the expansible chamber device comprising a plunger for pressurizing the expansible chamber when the plunger is actuated. The plunger is actuated by means of a cam that is mounted to a rotatable shaft that is rotated in synchronism with the operation of the press. Means are provided for releasably clamping the cam element to the shaft in a selectable angular position about the shaft whereby the angular position of the shaft during which the plunger is actuated can be varied.

It is an object of the present invention to provide a double feed roll lift system wherein synchronization of the separation and closing of the infeed and outfeed roll pairs is accomplished hydraulically, rather than by the previously used mechanical cross shafts.

It is a further object of the present invention to provide a double feed roll lift system wherein the times during the press cycle at which the infeed and outfeed rolls are separated and closed can be controlled independently of each other.

These and other objects of the present invention will become apparent from the detailed description of a preferred embodiment thereof considered together with the appropriate drawings.

BRIEF DESCRIPTION OF THE DRAWINGS

FIG. 3 is an enlarged sectional view of the feed mechanism showing the details of the feed rolls and lift cylinder;

FIG. 4 is a diagrammatic view of the double feed roll lift system according to the present invention;

FIG. 5 is a bottom view of the roll lifter drive mechanism;

FIG. 6 is a sectional view taken along line 6—6 of FIG. 5 and viewed in the direction of the arrows;

FIG. 7 is a sectional view taken along line 7—7 of FIG. 5 and viewed in the direction of the arrows; and FIG. 8 is a plan view of the piston and follower assembly.

DETAILED DESCRIPTION OF A PREFERRED EMBODIMENT

Figure 1:
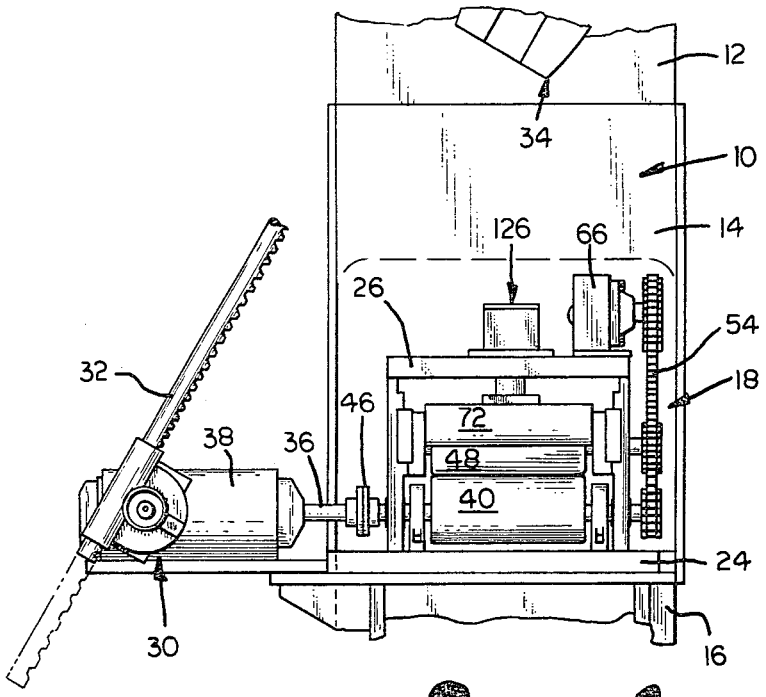
FIG. 1 is a fragmentary elevational view of a press and strip stock feed apparatus incorporating the lift system of the present invention.

Referring now in detail to the drawings, FIG. 1 illustrates a mechanical press 10 having a crown 12, uprights 14 and bed 16 to which is connected a strip stock feed apparatus 18 incorporating the lift system of the present invention. With additional reference to FIG. 3, the feed mechanism 18, which is positioned at the infeed side of press 10, comprises a frame having frame members 20 and 22 connected to a base member 24 and having an upper plate 26. The frame of feed mechanism 18 is attached to one side of press 10, and a generally similar feed mechanism 28, which is shown diagrammatically in FIG. 4, is attached to the other, outfeed side of press 10. Due to the similarity between feeds 18 and 28, only the infeed mechanism 18 will be described in detail.

Feed 18 is of the rack and pinion type and comprises a rack and pinion mechanism 30 including a rack 32 that is connected by a connecting rod (not shown) to a motorized micro feed length adjustment mechanism 34, a portion of which is illustrated in FIG. 1. This adjustment mechanism, which is described in detail in copending patent application Ser. No. 229,789, filed Jan. 30, 1981, enables the stroke of rack 32 to be adjusted so that the length of material fed into press 10 on each cycle thereof can be controlled. The intermittent motion produced by reciprocating rack 32 is connected to shaft 36 through gear box 38. Rack and pinion drives of this type have been used extensively in the press feed art, and for this reason, will not be described in any further detail. It should be noted that the lift system of the present invention is not limited to use with a rack and pinion feed, but could be used equally well with other types of feeds, such as cam feeds.

Lower feed roll 40 is connected to shaft 42, which in turn is supported within bearings 44. Shaft 42 extends through frame side members 20 and 22, and is connected to the output shaft 36 of gear box 38 through a conventional coupling 46. Upper feed roll 48 is connected to shaft 50, which is supported for rotation within bearings 52 that are connected to yoke 72.

Upper roll 48 is driven in synchronism with lower roll 40 by means of a double sided timing belt 54 and timing belt pulleys 56 connected to shaft 42, 58 connected to shaft 50, and 60, which is connected to idler shaft 62. Idler shaft 62 is supported for rotation within bearings 64, which are mounted within bearing housing 66 having a cover 68 connected thereto by screws 69. The inner side of timing belt 54 is in engagement with lower pulley 56 and idler pulley 60, whereas the outer side thereof is in engagement with the pulley 58 connected to upper roll shaft 50. As lower pulley 56 is driven intermittently by shaft 42, timing belt 54 will rotate upper pulley 58 in the opposite direction so that strip stock pinched between rolls 40 and 48 will be advanced into press 10.

The supports 70 for bearings 52 are connected to a yoke member 72, and the entire upper roll assembly is mounted for a limited degree of reciprocal movement in the vertical direction. Yoke member 72 is connected to the flange 74 of piston 76 by screws 77. Piston 76 is slidably received within cylinder 78, which has its flanged portion 80 connected to the upper plate 26 of feed mechanism 18 by screws 82.

Piston 76 is a double acting piston and comprises a flange 86 sealed against the inner wall 88 of cylinder 78 by O-ring 90. The shank portion 92 of piston 76 is sealed against cylinder 78 by O-rings 94. Pressure supplied within cylinder 78 through hydraulic line 100 to the upper side of piston 76 urges piston 76 downwardly so that yoke 72 and upper roll 48 are urged toward lower roll 40. Hydraulic fluid under pressure supplied to cylinder 78 through hydraulic line 102 to the lower side of piston 76 urges piston 76 upwardly and with it yoke 72 so as to separate rolls 40 and 48. An auxiliary piston element 104 slidably received within a bore 106 in piston 76 compresses spring 108 received in bore 106 when hydraulic pressure is supplied to the upper side of piston 76, and when hydraulic pressure is supplied through line 102 to the lower side of piston 76, the expansion of spring 108 drives piston element 104 upwardly. Spring 108 permits piston 76 to move upwardly without causing excessively high pressures to be developed on the upwardly facing surface of piston flange 86. Normally, a constant supply of hydraulic pressure is supplied to cylinder 78 through hydraulic line 100 to urge upper roll 48 downwardly thereby frictionally gripping the strip stock between it and lower roll 40.

The outfeed mechanism 28 (FIG. 4) is substantially identical to the infeed mechanism 18 described above. It comprises a frame having side members 112 and 114, a top plate 116 and upper and lower rolls 118 and 120. Lower roll 120 is pivotally connected to frame side members 112 by bearings similar to bearings 44 of mechanism 18 and is driven by a similar input shaft, which is rotated in incremental fashion in synchronism with shaft 36. Upper roll 118 is similarly pivotally connected to yoke 122, which is raised and lowered by the hydraulic cylinder assembly 124 similar to assembly 126 in FIG. 3. Feed mechanism 28 is connected to the opposite side of press 10 as is mechanism 18, and serves to grip and pull the strip stock out of press 10 at the same time that it is being pushed by the infeed mechanism 18.

The cylinders 78 of lift mechanisms 124 and 126 are connected by hydraulic lines 128 and 102, respectively, to the lifter drive mechanism 130, which is shown in detail in FIGS. 5–8. Lifter drive mechanism 130 comprises a base plate 132 to which a double cylinder housing 134 is connected by screws 136, and housing 134 has a pair of cylinder bores 138 and 139 therein. Bores 138 and 139 are connected to hydraulic lines 128 and 102 through inlet ports 140, and a pair of bleed valves 142 are provided for bleeding air out of the system so that the roll lifter drive 130 can function as a positive displacement hydraulic pump.

Slidably received within cylinder bores 138 and 139 are pistons 144 and 146, respectively, having seals 148 received in grooves therein and being integral with yoke portions 150 and 152, respectively. Cylindrical cam followers 154 and 156 are pivotally connected within yokes 150 and 152 by shafts 158 and 160.

A cam support shaft 162 is rotatably supported on base plate 132 by conventional pillow blocks 164 and has a sprocket 166 connected to one end thereof by split taper bushing 168, which is keyed to a slot 170 in shaft 162 and connected to sprocket 166 by screw 172.

A pair of cams 174 and 176 are frictionally and releasably clamped to shaft 162 by a pair of Trantorque wedge lock assemblies 178. Wedge lock assemblies 178, which are commercially available parts, comprise a tapered inner wedge member 180 in engagement with shaft 162, a tapered outer wedge member 182 disposed around inner member 180 and in engagement with cams 174 and 176 and a lock ring 184 threaded to the threaded end portion of inner member 180 and in abutment with outer member 182 to wedge it between the cam 174 or 176 and the inner member 180. This arrangement frictionally clamps cams 174 and 176 to shaft 162, yet permits the angular orientation of cams 174 and 176 to be altered independently of each other simply by loosening lock nuts 184, turning cams 174 and 176 to the desired respective positions, and then retightening lock nuts 184.

Sprocket 166 is connected by chain 200 to a sprocket 202 connected to a member of press 10 that rotates once each cycle of the press, such as the crankshaft extension or an auxiliary shaft geared or otherwise linked to the crankshaft. As shown in FIG. 7, cams 174 and 176 are engaged by cam followers 154 and 156, so that as cams 174 and 176 rotate pistons 144 and 146 will be reciprocated within their respective cylinders 138 and 139. With all air having been bled out of the system, the displacement of hydraulic fluid from cylinders 138 and 139 as the lobes of cams 174 and 176 press pistons 144 and 146 inwardly will cause a similar displacement of hydraulic fluid in lines 128 and 102. This, in turn, acts against the lower surface of piston flange 86 (FIG. 3) thereby driving pistons 76 upwardly and pulling upper rolls 48 and 118 away from their respective lower rolls 40 and 120. The hydraulic pressures and areas of pistons 76 are chosen such that the hydraulic pressure produced by pistons 144 and 146 will be sufficient to raise upper rolls 48 and 118. As the lobes of cams 174 and 176 rotate past followers 154 and 156, the hydraulic pressure above pistons 76 will force pistons 76 downwardly thereby displacing the hydraulic fluid back into cylinders 138 and 139 so that cam followers 154 and 156 always remain in contact with cams 174 and 176. Alternatively, the converse arrangement whereby pistons are normally forced upwardly and pressed downwardly by plungers 144 and 146 could be used.

If it is desired to cause one of the upper rolls 48 and 118 to be separated from its opposite roll at a different time in the cycle of the press than the other roll 48 or 118, all that is necessary is to loosen one of the wedge locking assemblies 178 and rotate the cam 174 or 176 to the new position. If desired, cams 174 and 176 can be provided with graduations or other indicia aligned with a cursor or shaft 162 as shown in FIG. 4.

Figure 2:
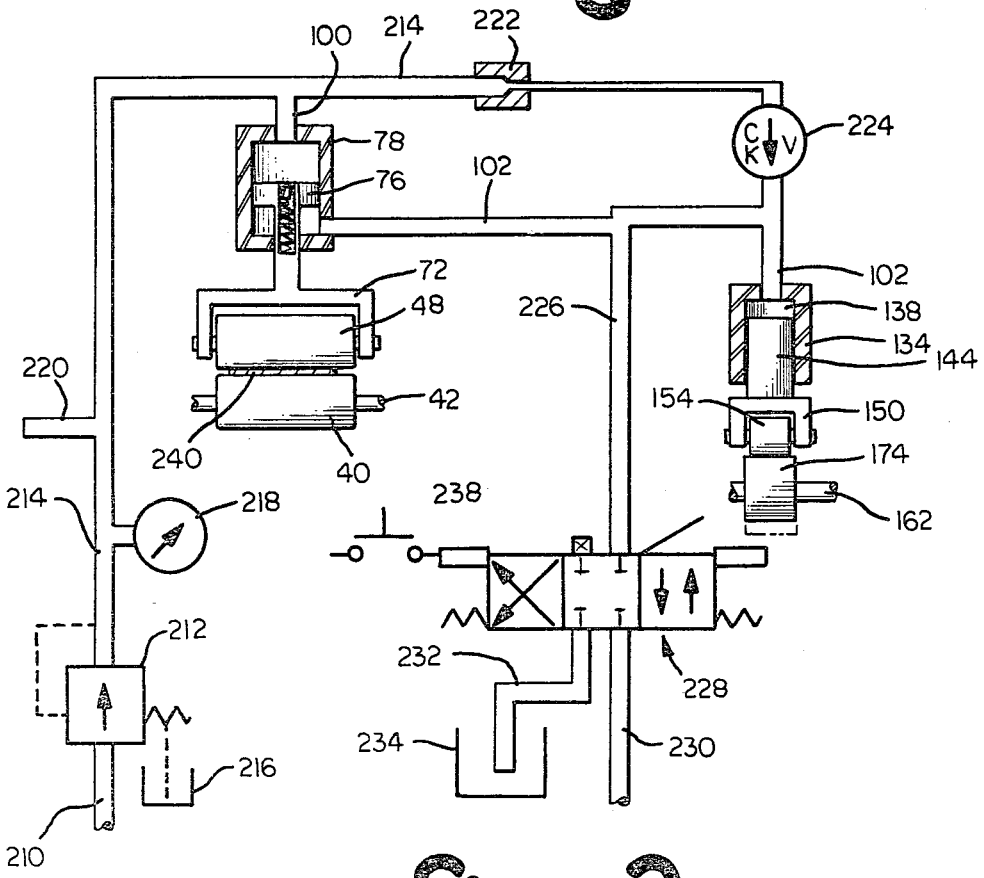
FIG. 2 is a hydraulic schematic of the feed roll lift system.

The hydraulic circuit of FIG. 2 shows in more detail the fluid connections employed in the system of the present invention. A hydraulic supply line 210 is connected to a regulator 212, the output side of which supplies hydraulic fluid to a conduit 214 at a lower pressure, and the relief side of regulator 212 is connected to sump 216. A guage 218 is connected to conduit 214 to enable the operator to adjust the hydraulic pressure to the desired level. Hydraulic line 100 is connected to one of the cylinders 78, and conduit 220 is connected to the other cylinder lift mechanism 124 (FIG. 4). Although only the hydraulic schematic for feed mechanism 18 is shown in FIG. 2, the hydraulic schematic for feed mechanism 28 is essentially identical. Conduit 214 is connected to cylinder 78 above piston 76 by conduit 100, and is connected through a restrictor 222 to the inlet of a check valve 224, the outlet side of which is connected to conduit 102 leading to cylinder bore 138.

The conduit 102 leading to cylinder 78 below piston 76 is connected by conduit 226 to a port of closed center control valve 228 having a high pressure conduit 230 connected to the inlet thereof and an exhaust conduit 232 connected to sump 234. Valve 228 in its centered position blocks off conduit 226 and in one actuated position connects conduit 226 with high pressure conduit 230 and in the other actuated position connects conduit 226 to exhaust conduit 232. When conduit 102 is pressurized, piston 76 will pull feed roll 48 upwardly away from driven roll 40.

During normal operation, valve 228 is in its centered position and, under these circumstances, each time piston 144 moves upwardly in cylinder 134, fluid will be pressurized and displaced cylinder 78 against the downwardly facing surface of piston 76, and will momentarily retract roll 48 away from roll 40. Valve 228 may be controlled in any conventional manner and, among other controls therefor, the sensor 238 provides for shifting of valve 228 into the position to retract roll 48 upwardly whenever the stock buckles in the press. The sensor 238 for detecting stock buckling may be of any conventional design presently used in the press industry.

Check valve 224 functions to enable fluid to be supplied as required to make up any leakage in the components connected to conduit 226, thereby keeping the system filled with hydraulic fluid on the upper sides of pistons 76 and 144. Thus, the cam actuated motion of piston 144 will be positively transmitted by pressurized and displaced fluid to produce a corresponding motion of piston 76 carrying upper feed roll 48. Solenoid valve 228 may be controlled by manual pushbuttons to shift its spool to the left to retract roll 48 so that the stock may be inserted between the feed rolls to start a new coil of stock into the press. Valve 228 may then have its spool shifted to the right by a pushbutton control to permit the space below piston 76 to be connected to exhaust so that pressurized fluid above piston 76 will cause it to lower bringing roll 48 into contact with the stock 240. No adjustment of any components is required to accommodate various conventional stock thicknesses; fluid will enter the space above piston 76 until the piston will no longer move downwardly. In practice, the electrical controls for valve 228 may be arranged to hold the spool in the right hand position for a sufficient length of time to fully seat roll 48 against the stock, and then deenergize the valve solenoid, thereby permitting the valve to move to its closed spring-centered position for operation of the feed mechanism 18.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a feed apparatus for feeding strip stock into a machine including first and second pairs of feed rolls adapted to be positioned, respectively, at the infeed and outfeed sides of the machine, the improvement being a roll lift system for independently lifting a roll of each pair comprising:

first means for urging one of the rolls of said first pair in a first direction either toward or away from the other roll of said first pair, a first expansible chamber means connected to said one roll for urging said one roll in a second direction opposite said first direction toward or away from the other roll of said first pair when the expansible chamber means is pressurized, second means for urging one of the rolls of said second pair in a third direction either toward or away from the other roll of said second pair, a second expansible chamber means connected to said one roll of the second pair for urging said one roll of the second pair in a fourth direction opposite said third direction toward or away from the other roll of said second pair when the expansible chamber means is pressurized, first and second positive displacement hydraulic actuator means connected to said first and second expansible chamber means, respectively, and each comprising a plunger, said actuator means pressurizing the respective expansible chamber means when the plunger thereof is actuated, a shaft rotatable about the axis and having a pair of cam elements mounted thereon, said shaft being mounted in close proximity to said plungers whereby said plungers are actuated by the cam elements as the shaft rotates, and means for adjusting the angular positions of said cam elements on said shaft independently of each other.

2. The feed apparatus of claim 1 in combination with a press having a rotating element that rotates once each cycle of the press, and including means for drivingly connecting said press rotating element with said shaft, whereby said shaft rotates in synchronism with the press and the pairs of rolls are thereby separated in synchronism with the press.

3. The feed apparatus of claim 1 wherein: said expansible chamber means each comprises a cylinder having a piston therein wherein one of the cylinders and pistons is connected to said one roll of the respective pair, and said first and second positive displacement actuator means each comprises a cylinder having the respective plunger therein, the cylinder of the expansible chamber means of one of the pairs is connected to one of the hydraulic actuator means cylinders by a first hydraulic line and the cylinder of the other pair is connected to the other hydraulic actuator means cylinder by a second hydraulic line.

4. The feed apparatus of claim 3 wherein said pistons are double acting pistons and said means for urging the rolls of the respective pairs in the first and third directions comprises means for pressurizing the respective expansible chamber cylinder on the opposite side of the piston contained therein.

5. The feed apparatus of claim 1 wherein each of said hydraulic actuator means comprises a cylinder having an outlet, a hydraulic line connecting said cylinder and the respective expansible chamber means, and said plungers each includes a piston which is slidably received in the respective cylinder.

6. The feed apparatus of claim 5 wherein said expansible chamber means, hydraulic lines and cylinders are filled with hydraulic fluid so that there is positive displacement of the hydraulic fluid in the lines and expansible chamber means when the plungers are actuated by said cam elements.

7. The feed apparatus of claim 6 wherein said expansible chamber means each comprises a cylinder having a piston therein wherein one of the cylinder and piston of each expansible chamber means is connected to said one roll of the respective pair, and said expansible chamber cylinders are connected to the respective hydraulic lines.

8. The feed apparatus of claim 5 wherein said cam elements are axially spaced on said shaft, and said means for adjusting the angular positions of said cam elements comprises means for independently frictionally clamping said cam elements to said shaft.

9. The feed apparatus of claim 5 including a chain and sprocket means for rotating said shaft.

10. The feed apparatus of claim 1 wherein said cam elements are axially spaced on said shaft, and said means for adjusting the angular positions of said cam elements comprises means for independently frictionally clamping said cam elements to said shaft.

11. The feed apparatus of claim 10 wherein said means for frictionally clamping comprises an annular tapered wedge element frictionally retained between each of said cams and said shaft.

12. In a feed apparatus for feeding strip stock into a machine including a pair of feed rolls adapted to be positioned either at the infeed or outfeed side of the machine, the improvement being a roll lift system for independently lifting a roll of the pair of feed rolls comprising:

means for urging one of the rolls of said pair in a first direction either toward or away from the other roll of said pair, an expansible chamber means connected to said one roll for urging said one roll in a second direction opposite said first direction toward or away from the other roll of said pair when the expansible chamber means is pressurized, positive displacement hydraulic actuator means connected to said chamber means and comprising a plunger, said hydraulic actuator means pressurizing the expansible chamber means when the plunger is actuated, a shaft rotatable about an axis and having a cam element mounted thereon, said shaft being mounted in close proximity to said plunger whereby said plunger is actuated by the cam as the shaft rotates, and means for releasably clamping said cam element to said shaft in a selectable angular position about said shaft whereby the angular range of rotation of said shaft during which said plunger is actuated can be varied.

13. The feed apparatus of claim 12 in combination with a press having a rotating element and including means for drivingly connecting said press rotating elements with said shaft, whereby said shaft rotates in synchronism with the press.

14. The feed apparatus of claim 12 wherein said expansible chamber means comprises a cylinder having a piston therein wherein one of the piston and cylinder is connected to said one roll of the pair, and said positive displacement hydraulic actuator means comprises a cylinder having a plunger received therein, and the cylinder of the expansible chamber means is connected to the hydraulic actuator cylinder by a hydraulic line.

15. The feed apparatus of claim 14 wherein said piston is a double acting piston and said means for urging the roll in said first direction toward or away from the other roll comprises means for pressurizing the expansible chamber cylinder on the opposite side of the piston.

16. The feed apparatus of claim 12 wherein said means for releasably clamping said cam element to said shaft comprises means for frictionally connecting said cam element to said shaft.

17. The feed apparatus of claim 12 wherein said means for releasably clamping said cam element to said shaft comprises an annular tapered wedge element and means for selectively wedging said wedge element frictionally between said cam element and said shaft.

* * * * *